US008919777B2

(12) United States Patent
Shigeta

(10) Patent No.: US 8,919,777 B2
(45) **Date of Patent: *Dec. 30, 2014**

(54) SHUFFLED PLAYING CARDS AND MANUFACTURING METHOD THEREOF

(71) Applicant: Angel Playing Cards Co., Ltd., Osaka (JP)

(72) Inventor: Yasushi Shigeta, Osaka (JP)

(73) Assignee: Angel Playing Cards Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/936,956

(22) Filed: Jul. 8, 2013

(65) Prior Publication Data

US 2013/0292902 A1 Nov. 7, 2013

Related U.S. Application Data

(63) Continuation-in-part of application No. 13/759,510, filed on Feb. 5, 2013, now Pat. No. 8,567,786, which is a continuation of application No. 12/832,566, filed on Jul. 8, 2010, now Pat. No. 8,387,983, which is a continuation of application No. 12/744,961, filed as application No. PCT/JP2008/071569 on Nov. 27, 2008, now Pat. No. 8,371,583, application No. 13/936,956, which is a continuation-in-part of application No. PCT/JP2012/006230, filed on Sep. 28, 2012.

(30) Foreign Application Priority Data

Nov. 27, 2007 (JP) ..... 2007-306173
Sep. 25, 2012 (JP) ..... 2012-227444

(51) Int. Cl.
*A63F 1/02* (2006.01)
*A63F 1/10* (2006.01)
*A63F 1/12* (2006.01)
*A63F 1/18* (2006.01)

(52) U.S. Cl.
CPC ... *A63F 1/02* (2013.01); *A63F 1/18* (2013.01); *A63F 1/10* (2013.01); *A63F 1/12* (2013.01)
USPC ..... 273/293

(58) Field of Classification Search
USPC ..... 273/293
See application file for complete search history.

(56) References Cited

U.S. PATENT DOCUMENTS 3,586,334 A * 6/1971 Baumann ..... 273/139
4,534,562 A * 8/1985 Cuff et al. ..... 273/149 P
4,619,367 A * 10/1986 Dorman ..... 209/608

(Continued)

*Primary Examiner* — Kurt Fernstrom
*Assistant Examiner* — Dolores Collins
(74) *Attorney, Agent, or Firm* — Sheppard, Mullin, Richter & Hampton LLP

(57) ABSTRACT

The present invention provides shuffled playing cards which eliminate the need for a game host to shuffle cards before games by taking a lot of time as well as eliminate the possibility of cheating. A shuffled playing cards (1) obtained by shuffling a predetermined number of decks of playing cards (12) using a shuffling machine is packaged as an individual pack. The shuffled playing cards (1) is individually packaged and sealed with an adhesive label (13). A bar code (13*a*) which represents a unique shuffled card ID has been printed on the adhesive label (13). The shuffled card ID is registered in a database by being associated with information which allows identification of a shuffling machine used to shuffle the playing card set.

24 Claims, 12 Drawing Sheets

(56) References Cited

U.S. PATENT DOCUMENTS

| | | | | |
|---|---|---|---|---|
| 4,995,615 | A * | 2/1991 | Cheng | 463/12 |
| 5,067,713 | A * | 11/1991 | Soules et al. | 273/149 P |
| 5,169,155 | A * | 12/1992 | Soules et al. | 273/293 |
| 5,431,399 | A * | 7/1995 | Kelley | 273/149 P |
| 5,522,623 | A * | 6/1996 | Soules et al. | 283/91 |
| 5,989,122 | A * | 11/1999 | Roblejo | 463/22 |
| 6,042,150 | A * | 3/2000 | Daley | 283/86 |
| 6,173,267 | B1 * | 1/2001 | Cairns | 705/14.12 |
| 6,220,960 | B1 * | 4/2001 | Kryzhanovsky | 463/13 |
| 6,233,497 | B1 * | 5/2001 | Kachi et al. | 700/173 |
| 6,640,974 | B2 * | 11/2003 | Malone | 206/449 |
| 6,886,829 | B2 * | 5/2005 | Hessing et al. | 273/149 R |
| 7,029,009 | B2 * | 4/2006 | Grauzer et al. | 273/149 P |
| 7,357,321 | B2 * | 4/2008 | Yoshida et al. | 235/454 |
| 7,374,170 | B2 * | 5/2008 | Grauzer et al. | 273/149 R |
| 7,556,197 | B2 * | 7/2009 | Yoshida et al. | 235/454 |
| 7,660,676 | B2 * | 2/2010 | Hirata et al. | 702/20 |
| 7,753,373 | B2 * | 7/2010 | Grauzer et al. | 273/149 R |
| 7,762,889 | B2 * | 7/2010 | Shigeta | 463/29 |
| 7,769,232 | B2 * | 8/2010 | Downs, III | 382/181 |
| 8,371,583 | B2 * | 2/2013 | Shigeta | 273/149 R |
| 8,387,983 | B2 * | 3/2013 | Shigeta | 273/149 R |
| 8,567,786 | B2 * | 10/2013 | Shigeta | 273/293 |
| 2007/0102879 | A1 * | 5/2007 | Stasson | 273/149 R |
| 2007/0111773 | A1 * | 5/2007 | Gururajan et al. | 463/11 |
| 2010/0103643 | A1 * | 4/2010 | Lin et al. | 362/16 |
| 2010/0224516 | A1 * | 9/2010 | Abell | 206/307 |
| 2010/0320684 | A1 * | 12/2010 | Mali | 273/149 R |
| 2010/0327525 | A1 * | 12/2010 | Shigeta | 273/149 R |
| 2011/0079959 | A1 * | 4/2011 | Hartley | 273/292 |

* cited by examiner (a)

(b)

SHUFFLED PLAYING CARDS AND MANUFACTURING METHOD THEREOF

CROSS-REFERENCE TO RELATED APPLICATIONS

This application is a continuation-in-part of U.S. patent application Ser. No. 13/759,510, filed Feb. 5, 2013, which is a continuation of U.S. patent application Ser. No. 12/832,566, filed Jul. 8, 2010, which is a continuation of U.S. patent application Ser. No. 12/744,961, filed Aug. 31, 2010, which is a U.S. national stage entry under 35 U.S.C. §371 of PCT International Application No. PCT/JP2008/071569, filed on Nov. 27, 2008, and claims priority to Japanese Application No. JP 2007-306173, filed on Nov. 27, 2007, the contents of which are incorporated herein by reference in their entirety. In addition, this application is a continuation-in-part of PCT International Application No. PCT/JP2012/006230, filed on Sep. 28, 2012, and also claims priority to Japanese Application No. JP 2012-227444, filed on Sep. 25, 2012.

TECHNICAL FIELD

The present invention relates to playing cards used for card games, and more particularly, to shuffled playing cards packaged as an individual pack after being shuffled in a sufficiently random manner and to a manufacturing method thereof.

BACKGROUND ART

In poker, baccarat, bridge, blackjack, and other card games, a dealer sets one or more decks of playing cards in a card shooter or the like and deals cards to game players by shooting the cards one by one out of the card shooter or the like. In so doing, to ensure fairness of the games, the cards need to be dealt at random. Therefore, a game host has to shuffle the playing cards sufficiently randomly before the playing cards are set in the card shooter.

A conventional card shuffling apparatus used to shuffle cards is disclosed, for example, in Patent Document 1.

Patent Document 1: Japanese Patent Laid-Open No. 2005-198668

However, when the game host shuffles cards before a game, the shuffling can sometimes take a lot of time, hampering efficient operation of the game. Also, when the game host shuffles, there is a problem of possible cheating such as insertion/removal or switching of cards.

The present invention has been made in view of the above problems and has an object to provide shuffled playing cards and manufacturing method thereof which eliminate the need for a game host to shuffle cards before games by taking a lot of time as well as eliminate the possibility of cheating.

SUMMARY

The present invention provides a manufacturing method of shuffled playing cards characterized by comprising: a shuffling step of shuffling a predetermined number of decks of playing cards by a shuffling machine and thereby producing a set of shuffled playing cards; a packaging step of individually packaging each shuffled playing cards subjected to the shuffling step; an ID generating step of creating a different shuffled card ID for each set of shuffled playing cards subjected to the shuffling step using an information processor; an ID affixing step of affixing the shuffled card ID as an ID code to a package of the shuffled playing cards; and an ID registration step of registering the shuffled card ID in a database by associating the shuffled card ID with information which allows identification of the shuffling machine or a shuffling machine group involved in the shuffling step of the shuffled playing cards affixed with the shuffled card ID.

The present invention provides shuffled playing cards which are a predetermined number of decks of playing cards shuffled and individually packaged, characterized in that a shuffled card ID for use to access information in a database is affixed as an ID code to a package of the shuffled playing cards, where the information allows identification of a shuffling machine or a shuffling machine group used to shuffle the shuffled playing cards.

The present invention can provide shuffled playing cards which eliminate the need for a game host to shuffle cards before games by taking a lot of time as well as eliminate the possibility of cheating. Also, since a shuffled card ID associated with information which allows identification of the shuffling machine or shuffling machine group used to shuffle the shuffled playing cards is affixed to the package, if there is any problem with playing cards and it is believed that the cause of the problem lies in a shuffling machine, the manufacturer can easily identify which shuffling machine or shuffling machine group has caused the problem and take quick measures.

BRIEF DESCRIPTION OF THE DRAWINGS

The features and advantages of the present invention will be more fully understood with reference to the following, detailed description of an illustrative embodiment of the present invention when taken in conjunction with the accompanying figures, wherein:

FIG. 9(*b*) is a cross-sectional view illustrating a main portion of a variation of the card movement restriction means according to another exemplary embodiment of the present invention that restricts the movement of cards from a card housing unit of the card shoe apparatus of FIG. 6 as viewed from the side.

DETAILED DESCRIPTION

Embodiments of shuffled playing cards and manufacturing method thereof according to the present invention will be described below with reference to the drawings.

Figure 1:
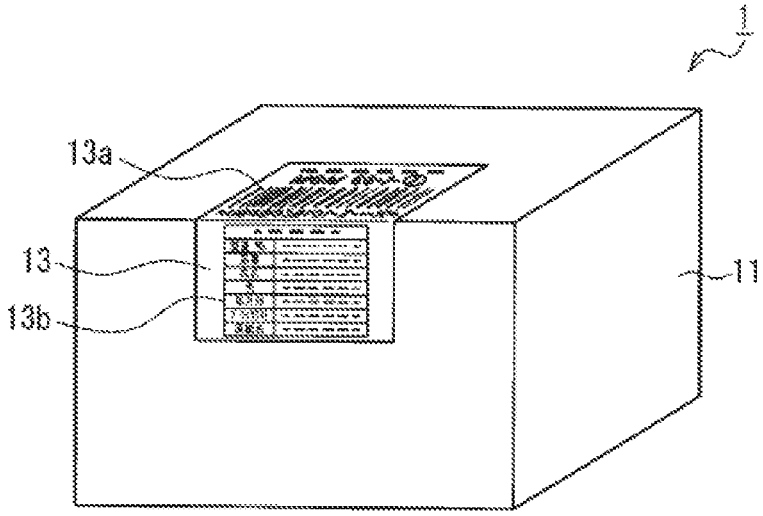
FIGS. 1(*a*) and 1(*b*) are perspective views showing appearance of a shuffled playing card set (packaged individually) according to an embodiment of the present invention.
Figure 1:
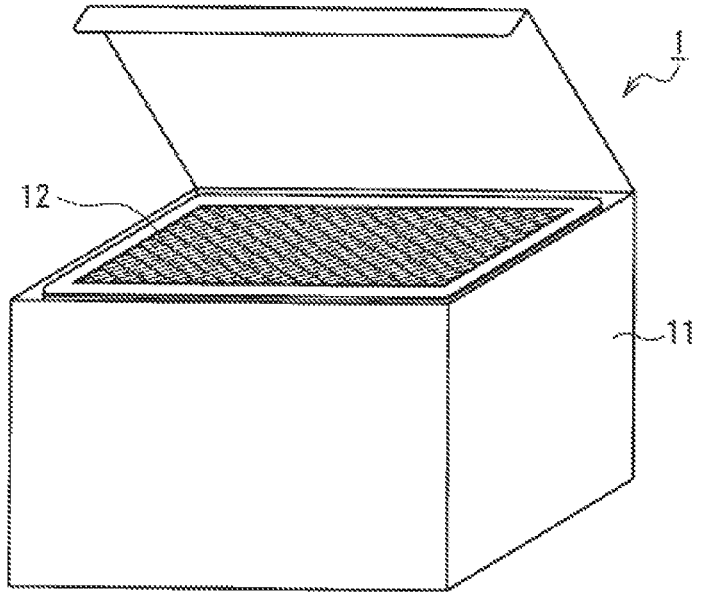

FIGS. 1(*a*) and 1(*b*) are perspective views showing appearance of a shuffled playing card set (packaged individually) according to one embodiment of the present invention. As shown in FIGS. 1(*a*) and 1(*b*), the shuffled playing card set 1 according to the present embodiment is sufficiently shuffled playing cards encased in a paper box 11 whose lid is sealed with an adhesive label 13. A predetermined number of decks (e.g., four decks or eight decks) form a set according to the type of game or the like in which the playing cards 12 are used. Incidentally, although a paper box is used for packaging in this example, the type of packaging is not limited to this. For example, a plastic box may be used alternatively. Instead of a box, the playing cards may be wrapped with a wrapper such as paper or plastic film and sealed with an adhesive label. The point is that the packaging can prevent the seal from being broken open before a game with subsequent cheating such as arranging cards in a different sequence, inserting or removing cards, or marking cards in some way or other.

A bar code 13*a* and specification table 13*b* are printed on the adhesive label 13. As described in detail later, the bar code 13*a* represents an ID (shuffled card ID) which can uniquely identify the shuffled playing card set 1. The specification table 13*b*, which is not absolutely necessary, can contain any information about the playing cards, such as a serial number, a product number, a product name, a color, and a date of manufacture.

As can be seen from FIGS. 1(*a*) and 1(*b*), since the shuffled playing card set 1 has a mouth of the lid of the paper box 11 sealed with the adhesive label 13, in order to use the shuffled playing card set 1, the adhesive label 13 has to be removed or broken. To prevent cheating, preferably the adhesive label 13 is made of a material which, once peeled off, cannot be returned to its original attached state or is configured to be broken at least partially upon application of an external force tending to peel off the adhesive label 13.

As described above, since the shuffled playing card set 1 according to the present embodiment contains shuffled playing cards 12 shuffled in a sufficiently random manner and packaged individually in the paper box 11 sealed with the adhesive label 13, in order to use the shuffled playing card set 1 in a game, it is only necessary to open the paper box 11 and set the playing cards 12 promptly in a shooter. This eliminates the need for a game host to shuffle the playing cards. It also eliminates the possibility of cheating such as insertion/removal or switching of cards during shuffling.

Next, the manufacturing method of the shuffled playing card set 1 according to the present embodiment will be described.

Preferably, a manufacturing process of the shuffled playing card set 1 according to the present embodiment is placed under consistent process control from order receipt to shipment by means of a process control system. A manufacturing process which uses such a process control system will be described in the present embodiment.

First, when an order is received from a customer, a manufacturer of the shuffled playing card set 1 assigns and enters an order receipt number in the process control system. The order receipt number may be assigned and entered using any desired method, and may be assigned automatically by the process control system.

As in the case of conventional playing cards, the shuffled playing card set 1 according to the present embodiment is manufactured using playing cards created through processes in which suit and rank are printed on one side of card base paper, a design is printed on the other side, and the printed card base paper is cut into individual cards on a cutting machine. Then, a predetermined number of decks of the playing cards are grouped together according to the application of the playing cards (depending on what game the playing cards will be used in), shuffled sufficiently randomly, packaged as an individual pack, and sealed to produce the shuffled playing card set 1 described above.

Before printing the card base paper, the manufacturer of the shuffled playing card set 1 enters base paper information (e.g., maker, product name, purchase date, paper lot number, and the like) in the process control system. In a printing process, the manufacturer of the shuffled playing card set 1 enters printing process information (printing machine number, printing date/time, lot number, and the like) in the process control system. Additionally, in a cutting process, the manufacturer of the shuffled playing card set 1 enters cutting process information (cutting machine number, cutting date/time, lot number, and the like) in the process control system. Consequently, predetermined information out of information entered in each process is associated with the shuffled card ID in a database of the process control system as described later.

Next, a shuffling process according to one embodiment of the present invention will be described.

Figure 2:
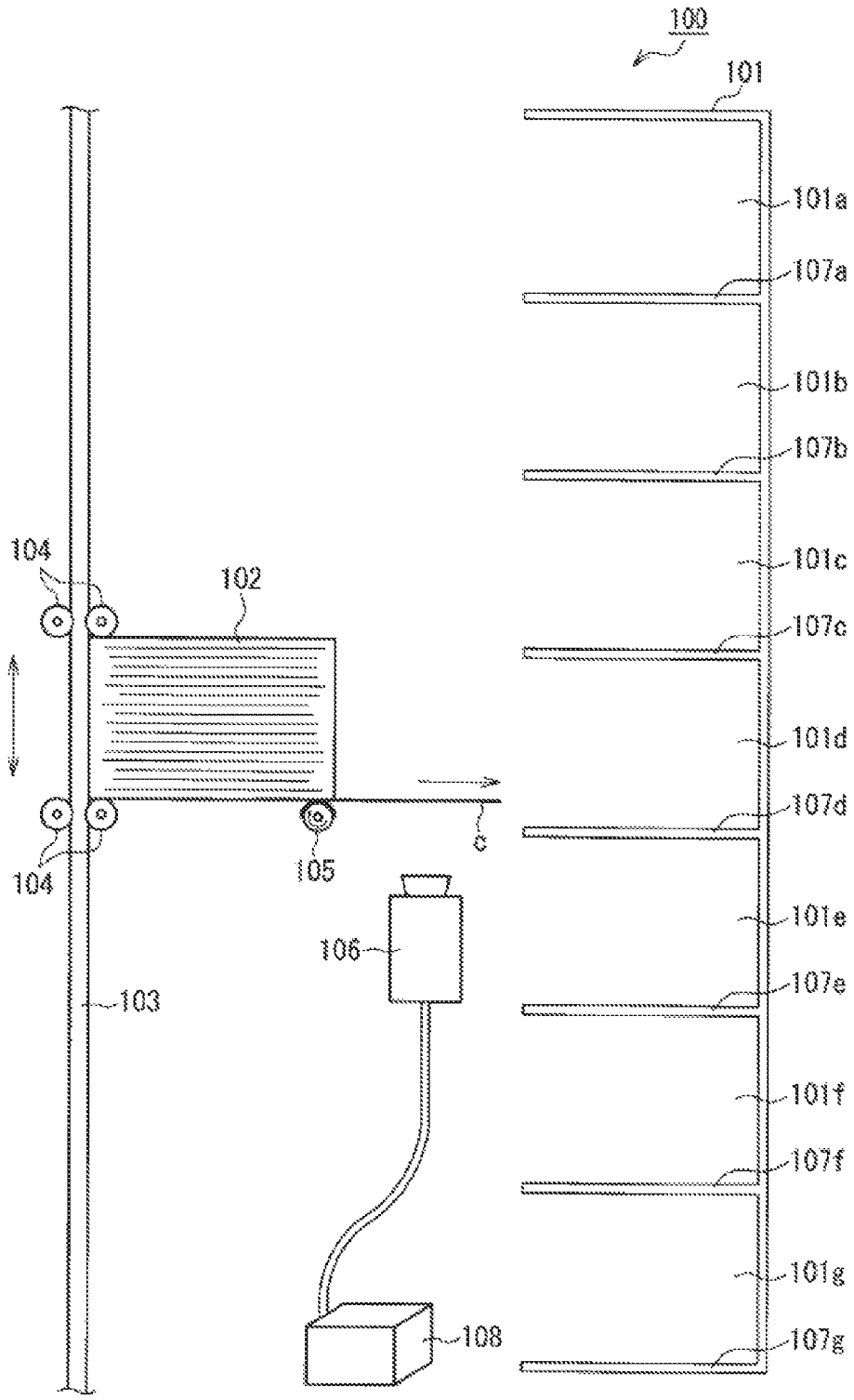
FIG. 2 is a diagram showing a schematic configuration of a shuffling machine used to shuffle playing cards in a manufacturing process of the shuffled playing card set according to the embodiment of the present invention.

FIG. 2 is a diagram showing a schematic configuration of a shuffling machine 100 used to shuffle playing cards in the manufacturing process of the shuffled playing card set 1 according to the present embodiment. As shown in FIG. 2, the shuffling machine 100 includes a card stack holder 101, a card feeder 102, a slide rail 103, feeder travel rollers 104, a card delivery roller 105, a camera 106 (or a card sensor 109 described later), and an image processing unit 108.

The card stack holder 101 has multiple pockets 101*a* to 101*g*. Incidentally, although in the configuration shown as an example in FIG. 2, the card stack holder 101 has seven pockets, the card stack holder 101 may have any number of pockets. Movable partition plates 107*a* to 107*f* are installed between the pockets. The card feeder 102 is designed such that when all the playing cards to be shuffled are placed on the card feeder 102, the card delivery roller 105 on the bottom rotates, sending out a card c from the lowermost part of the card feeder 102 toward the card stack holder 101 through a card delivery port provided in a lower flank of the card feeder 102. Also, the card feeder 102 is configured to be slidable in a vertical (up and down) direction along the slide rail 103 by means of the feeder travel rollers 104 driven by drive means such as a motor (not shown).

With the configuration described above, the shuffling machine 100 alternately slides the card feeder 102 to a position facing any of the pockets 101*a* to 101*g* and sends out the card c from the card feeder 102 to the pocket. Incidentally, the shuffling machine 100 determines the position to move the card feeder 102 to, i.e., the position facing one of the pockets 101*a* to 101*g*, at random using a random number generator program or the like. Consequently, the cards loaded in the card feeder 102 is sent out one by one in a random order to the pockets 101*a* to 101*g* of the card stack holder 101. When all the cards loaded in the card feeder 102 are sent out to the card stack holder 101, the partition plates 107*a* to 107*f* recede from the inside of the card stack holder 101 and consequently cards sorted into the pockets 101*a* to 101*g* of the card stack holder 101 are taken out of the shuffling machine 100 as a single stack. However, the receding of the pockets 101*a* to 101*g* is not absolutely necessary, and any alternative means may be used. For example, the cards may be taken out of the pockets 101*a* to 101*g* using a robot arm or the like. The above is a single shuffling process performed by the shuffling machine 100. After going through the shuffling process, a set of playing cards loaded in the card feeder 102 are shuffled to some extent. If the card feeder 102 is controlled so as to slide in a highly random manner, a set of playing cards loaded in the card feeder 102 can be shuffled sufficiently randomly after the shuffling machine 100 performs the shuffling process only once. However, as described later, if multiple shuffling machines 100 performing such a shuffling process are used to perform the shuffling process in sequence, the shuffled playing cards can be ordered more randomly.

The playing cards are loaded in the card feeder 102 with the face (side on which suit and rank are printed) down (to the side of the camera 106). Each time a card c is sent out from the card feeder 102 to the card stack holder 101, the camera 106 shoots an image of the card c. The resulting image is sent to the image processing unit 108. Functions of the camera 106 and image processing unit 108 vary among the shuffling machines 100 depending on the position of the shuffling machines 100 on a manufacturing line described below.

Figure 3:
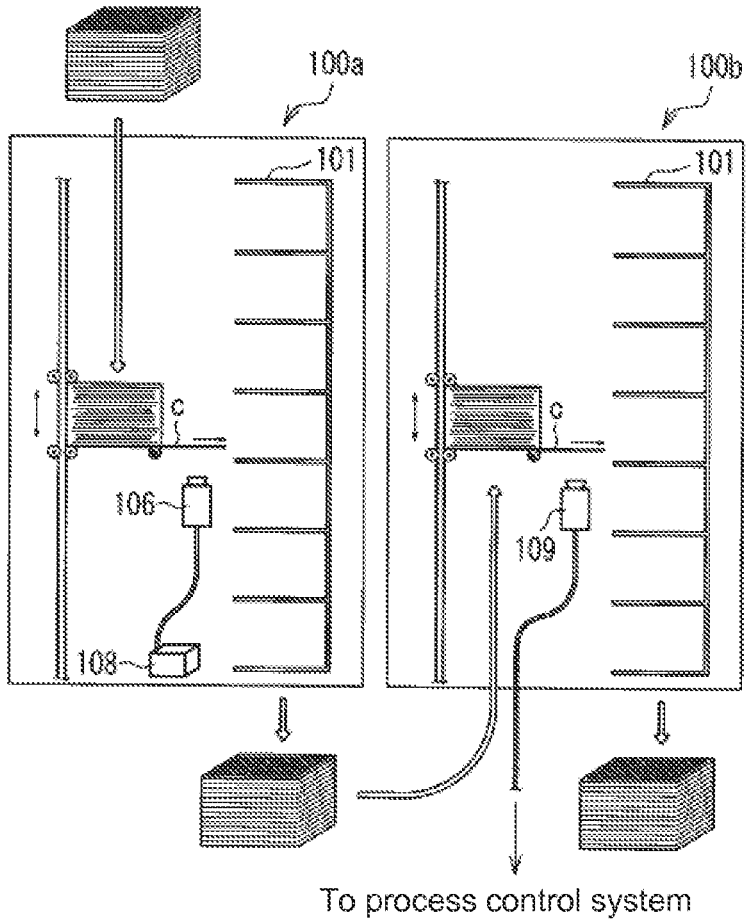
FIG. 3 is a schematic diagram showing part of a manufacturing line for the shuffled playing card set according to the embodiment of the present invention.

FIG. 3 is a schematic diagram showing part of a manufacturing line for the shuffled playing card set 1 according to the present embodiment. The manufacturing line includes multiple shuffling machines 100 configured as described above and arranged in a sequence. Incidentally, although a manufacturing line with two shuffling machines 100 (shuffling machines 100*a* and 100*b*) is shown as an example in FIG. 3, the number of shuffling machines 100 is not limited to this and may be one, or more than two. The shuffling machine 100*a* is configured as shown in FIG. 2, but the shuffling machine 100*b* is equipped with a card sensor 109 instead of the camera 106. The card sensor 109 has the capability to count the number of cards passing above the sensor.

As shown in FIG. 3, first, a set of playing cards made up of a predetermined number of decks is loaded into the card feeder 102 of the shuffling machine 100*a*. The set of playing cards subjected to the shuffling process by the shuffling machine 100*a* is loaded into the card feeder 102 of the shuffling machine 100*b*. The sliding of the card feeders 102 on the shuffling machines 100*a* and 100*b* are controlled independently of each other. After being subjected to the shuffling process twice by the shuffling machines 100*a* and 100*b*, the playing cards are shuffled more randomly.

An image of a card surface shot by the camera 106 on the shuffling machine 100*a* is subjected to an image analysis process by the image processing unit 108 of the process control system which manages the manufacturing line including the shuffling machines 100*a* and 100*b*, and consequently the suit and rank are detected on the card sent out from the card feeder 102 to the card stack holder 101. That is, on the shuffling machine 100*a*, each time a card is sent out from the card feeder 102 to the card stack holder 101, the rank and suit on the card are detected, and when the entire set of cards loaded in the card feeder 102 is sent out to the card stack holder 101, it is checked whether or not there is any excess or deficiency in the rank and suit combinations contained in the set of cards. For example, a set of cards made up of six decks should contain six each of identical cards in terms of the rank and suit combination. If there is any excess or deficiency in the rank and suit combinations, the set of cards is discarded as a defective item. In addition to the rank and suit checking, the image processing unit 108 inspects each card for any smudge and inspects a pattern of a back design and the like as well as inspects whether or not the cards have been cut properly and whether or not each card complies with predetermined standards. Any set of cards containing defects is discarded.

Figure 4:
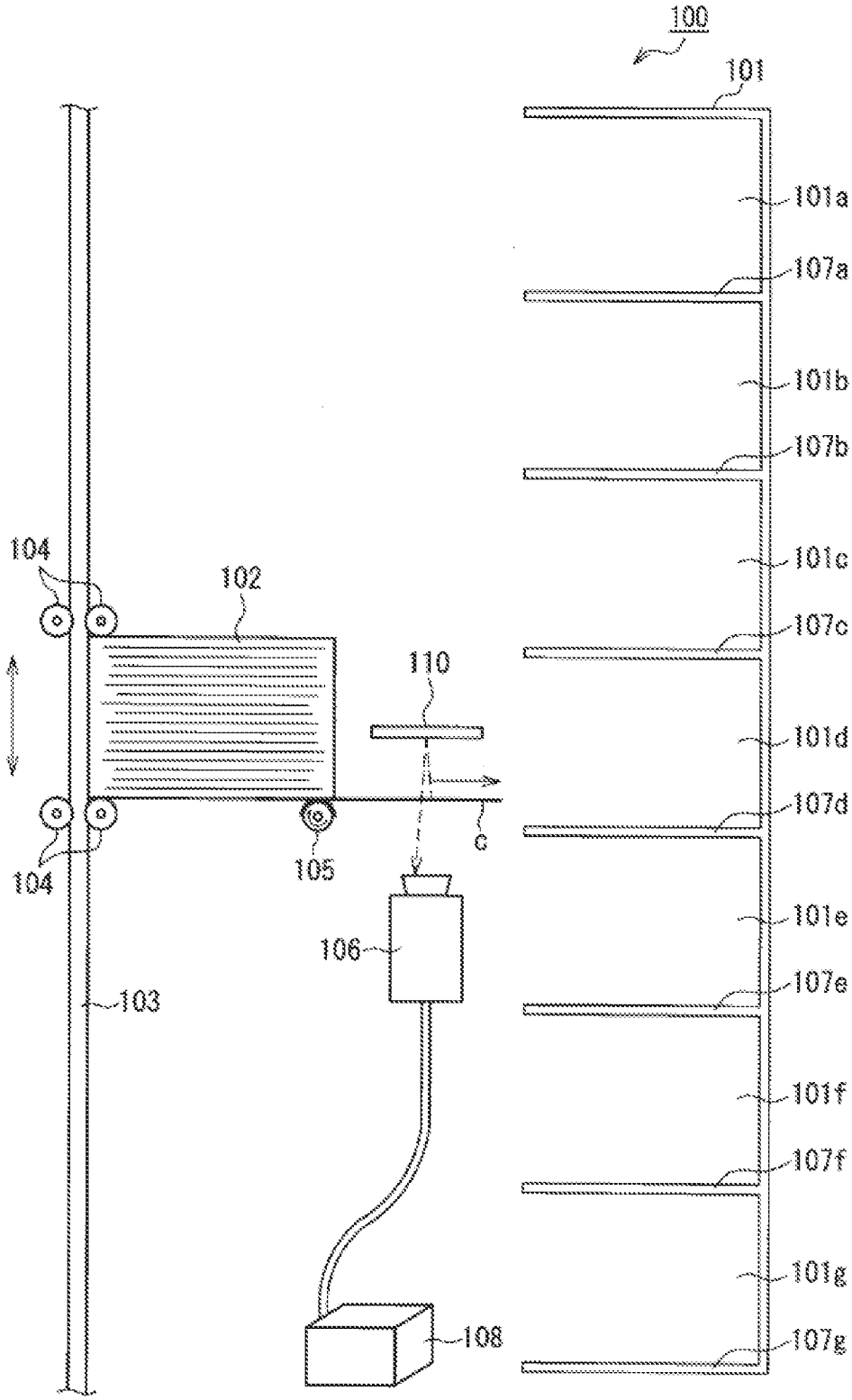
FIG. 4 is a diagram showing a variation of a schematic configuration of the shuffling machine according to the embodiment of the present invention.

Being installed on the shuffling machine 100*b* which performs the shuffling process the second time, the card sensor 109 counts the number of cards passing above the card sensor 109. If three or more shuffling machines are used, preferably the card sensor 109 is installed on the third and subsequent shuffling machines. In this way, the shuffling machine 100*b* checks the number of cards in the set of cards to be shuffled and thereby inspects the final product for excess or deficiency of cards. On the shuffling machine 100*a* which performs the shuffling process the first time, preferably both sides of the card is inspected simultaneously by installing a mirror 110 as shown in FIG. 4 so that the back side (patterned side) of the card will face the camera 106 or by installing another camera (not shown) which will photograph the back side of the card.

When the shuffling machine 100*b* which performs the final shuffling process finishes shuffling, the shuffling machine 100*b* outputs a shuffle-complete signal. Upon detection of the shuffle-complete signal, the process control system generates a shuffled card ID to be assigned to the set of shuffled playing cards completed through the final shuffling process. The shuffled card ID is generated as a unique ID for each shuffled playing card set 1. The process control system associates the generated shuffled card ID with predetermined information out of production information stored in the database of the process control system. Any desired type and volume of such information may be used, but information which identifies the manufacturing line or shuffling machines involved in the shuffling process is particularly important.

Specifically, if there are multiple manufacturing lines, the manufacturer of the shuffled playing card set 1 according to the present embodiment assigns a unique manufacturing line ID to each manufacturing line in advance. Then, upon generation of a shuffled card ID, the process control system registers the generated shuffled card ID in the database by associating the shuffled card ID with the manufacturing line ID of the manufacturing line involved in the manufacture of the shuffled playing cards. However, IDs are not limited to such manufacturing line-related IDs. Alternatively, a shuffling machine ID may be assigned to each shuffling machine in advance and the shuffled card ID may be registered in the database by being associated with all the shuffling machine IDs involved in the shuffling process. Incidentally, the database may be provided either in or outside the process control system.

The generated shuffled card ID is printed on the adhesive label as a bar code by a printing machine. Then, the adhesive label 13 on which the bar code of the shuffled card ID is printed is used to seal the paper box 11 as shown in FIG. 1(*a*).

Figure 5:
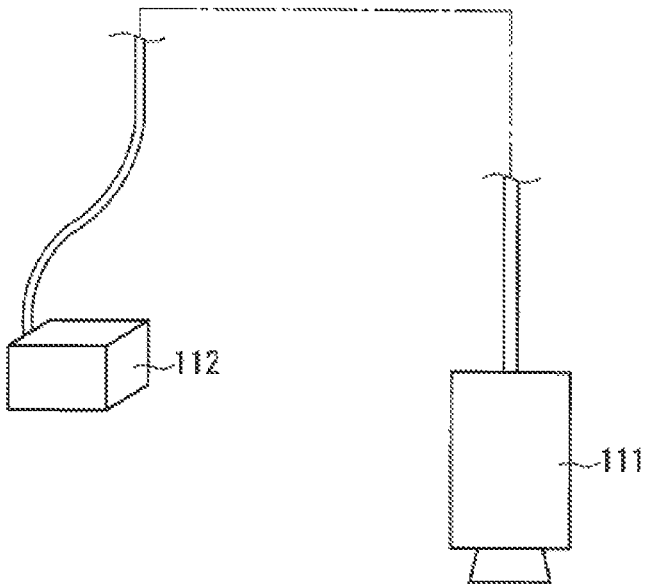
FIG. 5 is a diagram showing how an image used to check the number of playing cards is shot in the manufacturing process of the shuffled playing card set according to the embodiment of the present invention.
Figure 5:
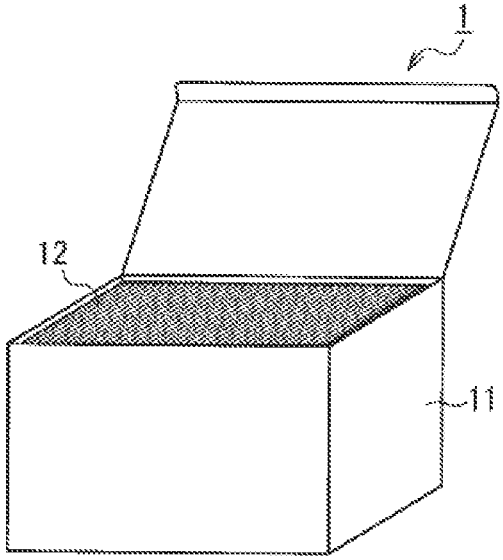

As a variation of the present embodiment, a process for shooting an image of the playing cards 12 encased in the paper box 11 may be added before the paper box 11 is sealed with the adhesive label 13. According to the variation, the set of playing cards 12 completed by going through the final shuffling process is encased in the paper box 11 with a side face up as shown in FIG. 5. Then, with the lid of the paper box 11 open, an image of the playing cards 12 encased in the paper box 11 is shot by a digital camera 111 as shown in FIG. 5. During shooting, preferably the bar code of the shuffled card ID is shot together in the same image. For example, in addition to the adhesive label 13 used to seal the paper box 11, one more adhesive label may be prepared, with the bar code of the same shuffled card ID printed thereon. Then, the additional adhesive label can be pasted on an inner side or the like of the lid of the paper box 11 and shot together with the playing cards 12. Image data resulting from the shooting is saved in a storage device 112 at least temporarily and then registered in the database by being associated with the shuffled card ID. Immediately after shooting, the paper box 11 is sealed with the adhesive label 13. Incidentally, although in the example shown in FIG. 5, an image is shot with the lid of the paper box 11 open, the form of image shooting for the purpose of checking the number of cards is not limited to this. For example, slits or the like may be formed in the lid of the paper box 11 so that the number of cards can be checked even when the lid is closed, and after the lid is closed and sealed, an image may be taken through the slits to check the number of cards. The slits may be sealed after the shooting, for example, using a sealing label other than the adhesive label 13 or using an outer lid.

The image data is used to prove later that a predetermined number of playing cards 12 (e.g., 416 cards in the case of an 8-deck shuffled playing cards) were all present when the paper box 11 was sealed. Otherwise, if the playing cards 12 are found to be excessive or deficient when the cards are used, it is not clear whether someone with malicious intent cheated by removing/slipping in cards or there were manufacturing defects in the first place. By acquiring and saving image data of the playing cards 12 at the time of sealing as with the present variation, it is possible to prove that there was no manufacturing defect. To judge the number of playing cards from the image data, image processing is carried out. That is, in the case of playing cards used, for example, in casinos and the like, to prevent suit and rank from being seen through the back, each card generally has a multilayered structure with black paper and the like being used as an intermediate layer. Consequently, the total number of playing cards 12 can be checked by image processing which detects the black paper or a white portion adjoining the black paper using image data. In the case of cards which do not have an intermediate layer or whose intermediate layer cannot be seen from the side, the total number of playing cards 12 can be checked by performing image processing to detect gaps between stacked playing cards using image data. Therefore, according to the present variation, preferably the image data acquired by shooting has a resolution high enough to enable image processing such as described above.

As described above, by registering the shuffled card ID of the shuffled playing card set 1 in the database by associating the shuffled card ID with the IDs of the manufacturing line or shuffling machine involved in the manufacture of the shuffled playing card set 1 (and with photographic image data such as described above, is necessary), the present embodiment provides the following advantages.

For example, if a customer who has purchased a shuffled playing card set 1 notices any defect in the purchased cards, the customer informs the manufacturer of the shuffled playing card set 1 about the shuffled card ID. In so doing, the customer may send the adhesive label 13 on which the bar code of the shuffled card ID is printed to the manufacturer so that the manufacturer will read the shuffled card ID using a barcode reader. Alternatively, the customer may read the shuffled card ID using a barcode reader or the like and send the obtained data to the manufacturer via communications means such as e-mail. Consequently, by searching the database using the shuffled card ID, the manufacturer can identify a manufacturing line or shuffling machine that may have a problem. In such a case, the manufacturer can alert customers about the shuffled playing card sets 1 manufactured on the same manufacturing line or shuffling machine in the same period and take measures, if necessary, such as requesting the customers to discard the product or recalling the product. Also, by inspecting the identified manufacturing line or shuffling machine, the manufacturer can prevent a recurrence of the defect.

Also, the manufacturer may deliver the shuffled playing card set 1 to the customer together with a portable storage medium containing data (shuffled card ID and related information) on the shuffled playing card set 1 to be delivered by downloading the data from the database at the time of delivery. Any data structure (format) may be used for the data downloaded from the database to the storage medium as long as the data is readable on the customer's computer. Then, if the customer finds a defect such as a bent card, the customer can read the shuffled card ID of the defective shuffled playing card set 1 using a barcode reader or the like and search data on the storage medium based on the shuffled card ID thus acquired. Also, based on search results, the customer can take measures such as discarding shuffled playing card sets 1 related to the same manufacturing line or shuffling machine. Besides, even if fraudulent shuffled playing card sets 1 are mixed in items delivered to the customer, the customer can check the shuffled card IDs of the delivered items with the shuffled card IDs stored in the storage medium. Then, any shuffled playing card set 1 whose shuffled card ID is not contained in the storage medium provided at the time of delivery can be determined to have been mixed for fraudulent purposes. This prevents mixing of fraudulent items by a third party.

Although in the embodiment described above, the manufacturing line ID or the shuffling machine ID of the shuffling machine that performed the shuffling process is stored in the database by being associated with the shuffled card ID, information to be associated with the shuffled card ID is not limited to this. For example, in the above embodiment, the camera 106 is incorporated in the shuffling machine 100 and the image analysis process is performed by the image processing unit 108 simultaneously with shuffling to inspect whether or not all the cards are present. However, as a variation, inspection machines including the camera 106 and image processing unit 108 may be installed downstream of each shuffling process, so that the cards having completed shuffling by the shuffling machines 100*a* and 100*b* can be inputted in the inspection machines to inspect whether or not all the cards are present. In that case, an inspection machine ID may be assigned to each inspection machine in advance and associated with the shuffled card ID assigned to each shuffled playing card set 1.

Besides, various information can be associated with the shuffled card ID, including an ID of the printing machine involved in the printing process, an ID of the cutting machine involved in the cutting process, an ID of the packaging machine involved in a packaging process, a lot number of the base paper, a manufacturing date, a manufacturing date/time, a card type ID, and a customer ID. In that case, the information can be registered in the database by being associated with the shuffled card ID containing the information.

In the above embodiment, the paper box 11 is sealed with the adhesive label 13 on which the shuffled card ID is printed as a bar code. However, forms of the present invention are not limited to this. The shuffled card ID may be affixed to the package as a two-dimensional matrix code such as a so-called QR code. Also, the shuffled card ID may be recorded somewhere other than the sealing label. That is, a method which records the shuffled card ID directly on the package may also be adopted. For example, the shuffled card ID can be affixed to the package by laser irradiation or the like. It is also preferable to attach the shuffled card ID to the package as a PFID or RFID (so-called IC tag).

Furthermore, although in the present embodiment, one shuffled card ID is assigned to one shuffled card set 1, a unique ID may be assigned, for example, to each carton packed with multiple shuffled card sets 1. Alternatively, a unique ID may be assigned to each container used to transport multiple cartons. Even in these cases, if the ID is registered in the database, when any defect is found later, by searching the database based on the ID, it is possible to trace manufacturing and distribution history of the defective product.

For example, in a cartoning process, a predetermined number of shuffled card sets 1 (boxes) are packed in a carton. In so doing, by reading the bar codes 13*a* of the shuffled card sets 1 packed in the carton using a barcode reader, the shuffled card IDs of the shuffled card sets 1 in the carton can be registered easily in the database of the process control system. After the bar codes 13*a* are read from all the shuffled card sets 1 in the carton, the process control system may generate an ID (carton ID) for use to identify the carton and print a bar code which represents the carton ID on an adhesive label. The adhesive label, when pasted to the carton, will enable carton-based management. The generated carton ID is registered in the database by being associated with the shuffled card IDs of the shuffled card sets 1 packed in the carton.

Similarly, when a predetermined number of cartons are loaded on a pallet and multiple pallets are put in a container, the carton IDs may be read from all the cartons loaded on one pallet using a barcode reader and the acquired carton IDs may be registered in the database of the process control system by being associated with an ID (pallet ID) for use to identify the pallet. In that case, after the bar codes are read from all the cartons on one pallet, the process control system generates an ID (pallet ID) for use to identify the pallet and prints the bar code which represents the pallet ID on an adhesive label. The adhesive label, when pasted to the pallet, will enable pallet-based management. When the pallet is loaded in the container, the use of the pallet's bar code makes it possible to record which container the pallet is loaded in.

When the loading into the container is completed, shipment information (customer name, shipment date, destination, transport company, type of delivery service, and the like) by the pallet or container is inputted in the process control system.

Thus, in addition to attaching the shuffled card ID to packages, if a carton ID or pallet ID are attached to cartons or pallets, the shuffled playing cards can be managed on a carton-by-carton basis or pallet-by-pallet basis. Specifically, for example, if any defect is found in a shuffled card set 1, the database can be searched for the IDs of the carton, pallet, and container in which the shuffled card set 1 was contained, based on the shuffled card ID of the shuffled card set 1. This also makes it possible to discard all the shuffled card sets 1 in the carton, pallet, or container in which the defective shuffled card set 1 was contained.

The shuffling machine 100 illustrated in the above embodiment is strictly exemplary, and concrete configuration of the shuffling machine is not limited to the above example. For example, in the above, although the card feeder 102 is configured to move by sliding, the card feeder 102 may be fixed, being configured such that the card stack holder 101 will slide relative to the card feeder 102. Also, the configuration for sending out the card from the card feeder 102 is not limited to delivery rollers such as described above, and a mechanism such as a robot arm may be used to take out the card.

Also, although in the above embodiment, the shuffling machine 100*b* issues a shuffled card ID in response to a shuffle-complete signal, the timing to issue the shuffled card ID is not limited to this. For example, the shuffled card ID may be issued at any time such as at the end of an inspection process.

An embodiment of the present invention has been described above, and the scope of the present invention also covers the following annexes.

[Annex 1]

A playing card manufacturing method comprising a manufacturing process including:

a face printing step of printing rank and suit of playing cards on one side of base paper;

a back side printing step of printing a back design on another side of the base paper;

a step of cutting a card base paper printed in both the face printing step and the back side printing step into individual playing cards on a cutting machine;

a shuffling step of gathering the individual playing cards cut in the cutting step into a predetermined number of decks and shuffling the playing cards to produce a set of shuffled playing cards; and a packaging step of packaging the individual shuffled playing cards produced in the shuffling step, characterized in that a different shuffled card ID is created for each of the individual shuffled playing cards using an information processor in response to a shuffle completion signal from a shuffling machine which carries out the shuffling step, the playing card manufacturing method further comprises an ID affixing step of affixing the shuffled card ID as an ID code to a package of the individual shuffled playing cards, and the shuffled card ID represented by the ID code is configured in a database by being associated with information about the shuffling machine involved in the shuffling step of the corresponding individual shuffled playing cards or information about a production line including the shuffling machine and involved in the manufacturing process, and the database is configured so as to allow identification of the shuffling machine or the production line including the shuffling machine based on the shuffled card ID, the shuffling machine having been involved in the shuffling step in the manufacturing process of the individual playing cards which make up the individual shuffled playing cards.

[Annex 2]

A playing card manufacturing method comprising a manufacturing process including:

a face printing step of printing rank and suit of playing cards on one side of base paper;

a back side printing step of printing a back design on another side of the base paper;

a step of cutting a card base paper printed in both the face printing step and the back side printing step into individual playing cards on a cutting machine;

a shuffling step of gathering the individual playing cards cut in the cutting step into a predetermined number of decks and shuffling the playing cards to produce a set of shuffled playing cards; and an inspection step of performing an inspection using an inspection machine during or after the shuffling step to ensure that the individual playing cards in the predetermined number of decks which make up the shuffled playing cards are all present;

a packaging step of packaging the individual shuffled playing cards produced in the shuffling step, characterized in that a different shuffled card ID is created for each of the individual shuffled playing cards using an information processor in response to an acceptance signal given by the inspection machine in the inspection step, the playing card manufacturing method further comprises an ID affixing step of affixing the shuffled card ID as an ID code to a package of the individual shuffled playing cards, and the shuffled card ID is configured in a database by being associated with information about the inspection machine involved in the inspection step of the corresponding individual shuffled playing cards or information about a production line including the inspection machine and involved in the manufacturing process, and the database is configured so as to allow identification of the inspection machine or the production line including the inspection machine based on the shuffled card ID, the inspection machine having been involved in the inspection step in the manufacturing process of the individual playing cards which make up the individual shuffled playing cards.

[Annex 3]

The playing card manufacturing method according to annex 1 or 2, further comprising a step of inputting data which identifies a printing machine used in at least one of the face printing step and the back side printing step, in the information processor, characterized in that the information about the production line which performs the manufacturing process for the individual shuffled playing cards includes the data which identifies the printing machine, and the database is configured so as to allow identification of the printing machine used in the production line for the individual playing cards which make up the individual shuffled playing cards, based on the shuffled card ID.

[Annex 4]

The playing card manufacturing method according to annex 1 or 2, characterized in that the information about the production line which performs the manufacturing process for the individual shuffled playing cards includes a lot number of the base paper used in the face printing step or the back side printing step, and the database is configured so as to allow identification of the lot number corresponding to the individual playing cards which make up the individual shuffled playing cards, based on the shuffled card ID which identifies the individual shuffled playing cards.

[Annex 5]

The playing card manufacturing method according to any one of annexes 1 to 4, characterized in that the predetermined number of decks which make up the individual shuffled playing cards is any of 1 to 10.

[Annex 6]

The playing card manufacturing method according to any one of annexes 1 to 5, further comprising a step of packing a plurality of the packaged individual shuffled playing cards into a transport box, wherein different transport box data is created for each of the transport boxes; the playing card manufacturing method further comprises a step of affixing the corresponding transport box data as an ID code on a surface of the transport box; and the transport box data is included in the database by being associated with the shuffled card IDs which identify the shuffled playing cards in the transport box.

[Annex 7]

The playing card manufacturing method according to any one of annexes 1 to 6, characterized in that the ID code further contains any of manufacturing date, manufacturing date/time, product type, and customer information concerning the shuffled playing cards identified by the shuffled card ID.

[Annex 8]

The playing card manufacturing method according to any one of annexes 1 to 7, wherein the ID code which represents the shuffled card ID is attached in barcode format to the corresponding package of the shuffled playing cards.

[Annex 9]

The playing card manufacturing method according to any one of annexes 1 to 7, wherein the ID code which represents the shuffled card ID is attached in QR code (two-dimensional matrix code) format to the corresponding package of the shuffled playing cards.

[Annex 10]

The playing card manufacturing method according to any one of annexes 1 to 7, wherein the ID code which represents the shuffled card ID is attached in PFID format to the corresponding package of the shuffled playing cards.

[Annex 11]

The playing card manufacturing method according to any one of annexes 1 to 7, wherein the ID code which represents the shuffled card ID is attached in IC tag format to the corresponding package of the shuffled playing cards.

[Annex 12]

Shuffled playing cards manufactured in a manufacturing process which includes:

a face printing step of printing rank and suit of playing cards on one side of base paper;

a back side printing step of printing a back design on another side of the base paper;

a step of cutting a card base paper printed in both the face printing step and the back side printing step into individual playing cards on a cutting machine;

a shuffling step of gathering the individual playing cards cut in the cutting step into a predetermined number of decks and shuffling the playing cards to produce a set of shuffled playing cards; and a packaging step of packaging the individual shuffled playing cards produced in the shuffling step, characterized in that a shuffled card ID created for each individual shuffled playing cards in response to a shuffling step completion signal from the shuffling step is attached to the corresponding package of the individual shuffled playing cards, where the shuffled card ID differs among individual shuffled playing cards, the shuffled card ID is configured in a database by being associated with information about the shuffling machine involved in the shuffling step of the corresponding individual shuffled playing cards or information about a production line including the shuffling machine and involved in the manufacturing process, allowing identification of the shuffling machine or the production line including the shuffling machine, the shuffling machine having been involved in the shuffling step in the manufacturing process of the individual playing cards which make up the individual shuffled playing cards.

[Annex 13]

Shuffled playing cards manufactured in a manufacturing process which includes:

a face printing step of printing rank and suit of playing cards on one side of base paper;

a back side printing step of printing a back design on another side of the base paper;

a step of cutting the card base paper printed in both the face printing step and the back side printing step into individual playing cards on a cutting machine;

a shuffling step of gathering the individual playing cards cut in the cutting step into a predetermined number of decks and shuffling the playing cards to produce a set of shuffled playing cards; and an inspection step of performing an inspection using an inspection machine during or after the shuffling step to ensure that the individual playing cards in the predetermined number of decks which make up the shuffled playing cards are all present; and a packaging step of packaging the individual shuffled playing cards produced in the shuffling step, characterized in that a shuffled card ID created for each individual shuffled playing cards in response to an acceptance signal given by the inspection machine in the inspection step is attached to the corresponding package of the individual shuffled playing cards, where the shuffled card ID differs among individual shuffled playing cards, the shuffled card ID is configured in a database by being associated with information about the inspection machine involved in the inspection step of the corresponding individual shuffled playing cards or information about a production line including the inspection machine and involved in the manufacturing process, allowing identification of the inspection machine or the production line including the inspection machine, the inspection machine having been involved in the inspection step in the manufacturing process of the individual playing cards which make up the individual shuffled playing cards

[Annex 14]

The shuffled playing cards according to annex 12 or 13, characterized in that the ID code further contains any of manufacturing date, manufacturing date/time, product type, and customer information concerning the shuffled playing cards identified by the shuffled card ID.

[Annex 15]

The shuffled playing cards according to according to any one of annexes 12 to 14, characterized in that the predetermined number of decks is any of 1 to 10.

[Annex 16]

The playing card manufacturing method according to any one of annexes 12 to 15, characterized in that the ID code which represents the shuffled card ID is attached in barcode format or two-dimensional matrix code format (such as QR code format) to the corresponding package of the shuffled playing cards.

[Annex 17]

The shuffled playing cards according to annex 16, characterized in that the ID code is printed on a label, which is attached to the package of the shuffled playing cards.

[Annex 18]

The shuffled playing cards according to annex 16, characterized in that the ID code is attached to the package of the individual shuffled playing cards using a laser beam.

[Annex 19]

The playing card manufacturing method according to any one of annexes 12 to 15, wherein the ID code which represents the shuffled card ID is attached in PFID format to the corresponding package of the shuffled playing cards.

[Annex 20]

The playing card manufacturing method according to any one of annexes 12 to 15, wherein the ID code which represents the shuffled card ID is attached in IC tag format to the corresponding package of the shuffled playing cards.

[Annex 21]

The shuffled playing cards according to any one of annexes 12 to 20, wherein a tamper-evident adhesive label is attached to the package of the individual shuffled playing cards.

Industrial Applicability

The present invention has industrial applicability in the field of shuffled playing cards and a manufacturing method thereof.

Figure 6:
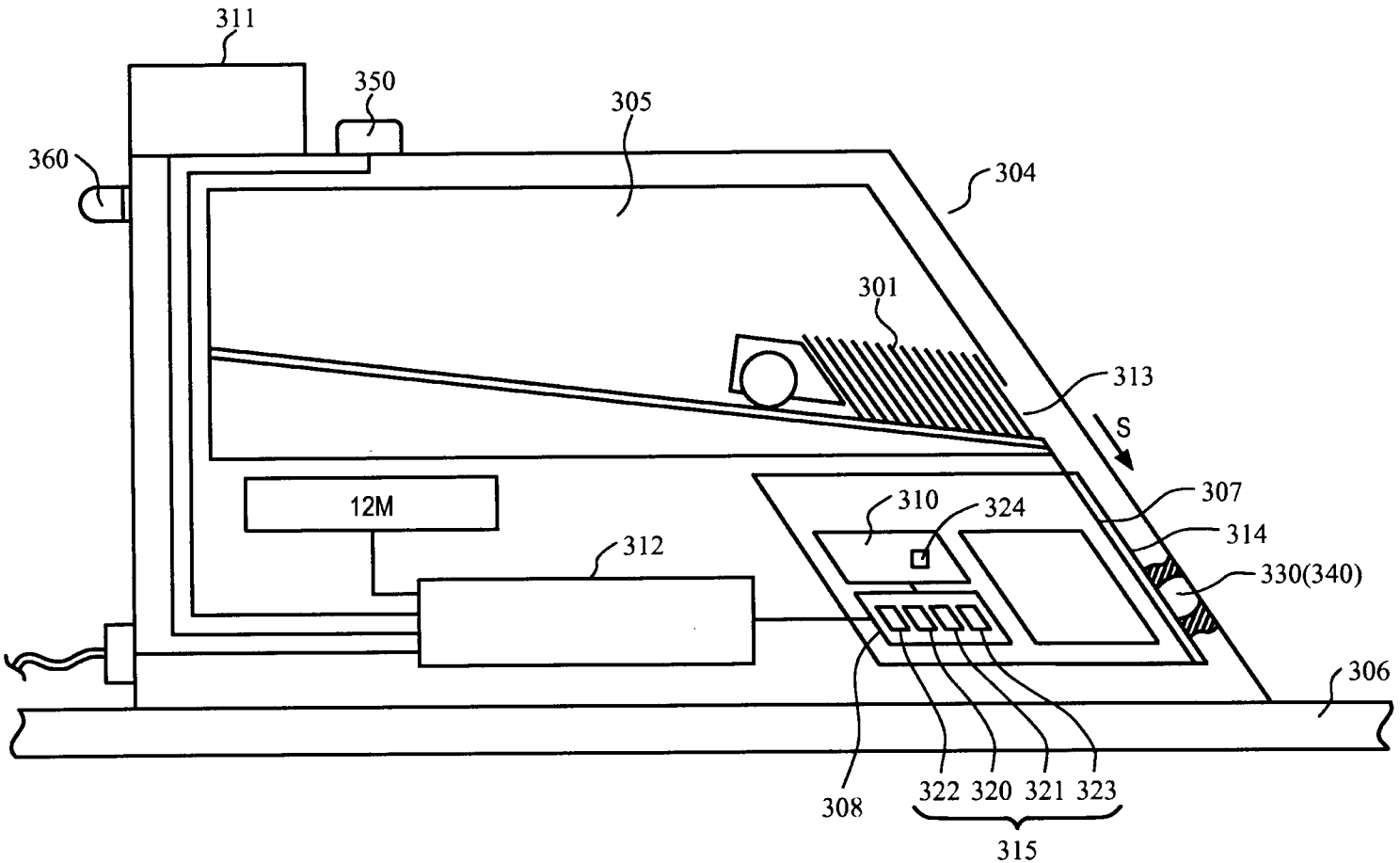
FIG. 6 is a block diagram illustrating the entirety of a card shoe apparatus according to an exemplary embodiment of the present invention.
Figure 7:
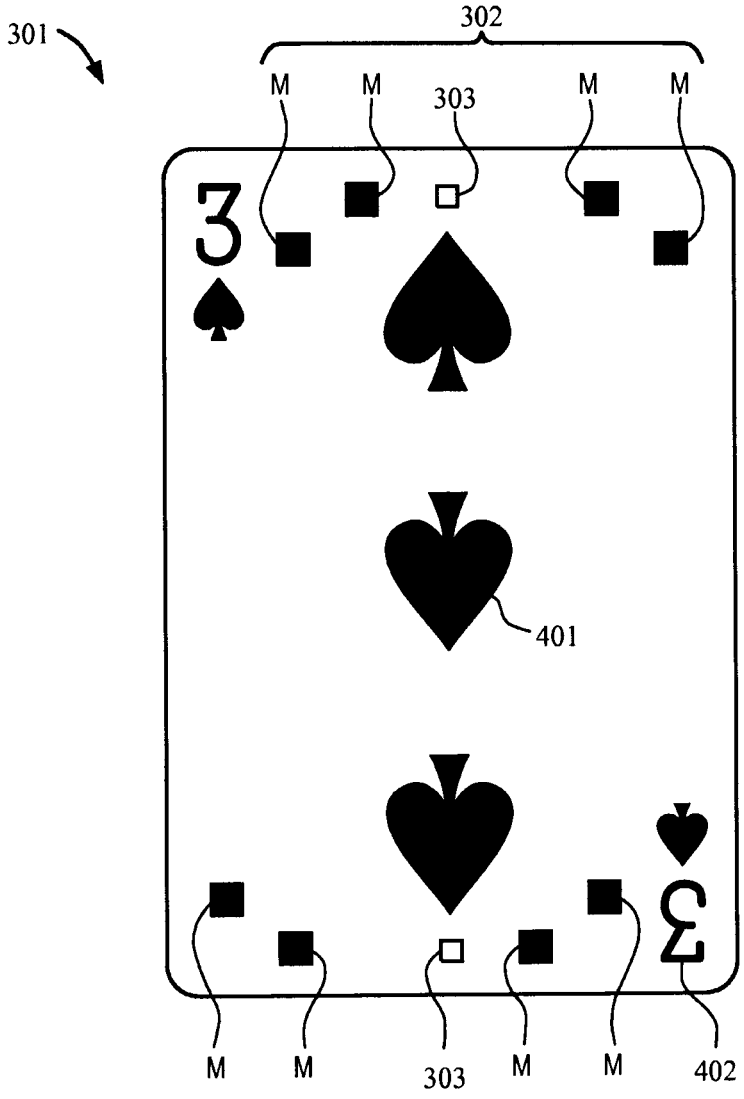
FIG. 7 shows an example of a card according to an exemplary embodiment of the present invention.

An embodiment of a table game system of the present invention will be described below in detail. FIG. 6 is a block diagram illustrating a card shoe apparatus, generally designated by reference number 304, for use in a table game system according to an exemplary embodiment of the present invention. FIG. 7 illustrates a card 301 that may be used in the table game system according to an exemplary embodiment of the present embodiment. The card 301 may be used in a table game such as baccarat. A code 302 may be disposed at the upper side and the lower side of the face of the card 301 in a point-symmetric manner. The code 302 may be composed of marks M that are invisible to the naked eye. Also, the card 301 includes an authenticity determination code 303 made up of coded information that indicates the authenticity of the card. The authenticity determination code 303 is arranged by printing or the like so as to be invisible to the naked eye, using, for example, ultraviolet reactive ink.

The card shoe apparatus 304 includes a card guide unit 307 that guides cards 301 that are manually drawn out one by one from a card housing unit 305 onto a game table 306, a code reading unit 308 that reads, when a card 301 is manually drawn out from the card housing unit 305 by a dealer or the like of a casino, the code 302 that indicates a figure (number, rank) of that card 301, a winning/losing determination unit 310 that determines the winning/losing of the card game based on the numbers of the cards 301 sequentially read by the code reading unit 308, and an output means 311 that outputs the result of the determination made by the winning/losing determination unit 310. The card guide unit 307 includes a card movement restriction means 330, 340 (to be described later) that restricts the movement of the card 301 from the card housing unit 305.

Figure 8:
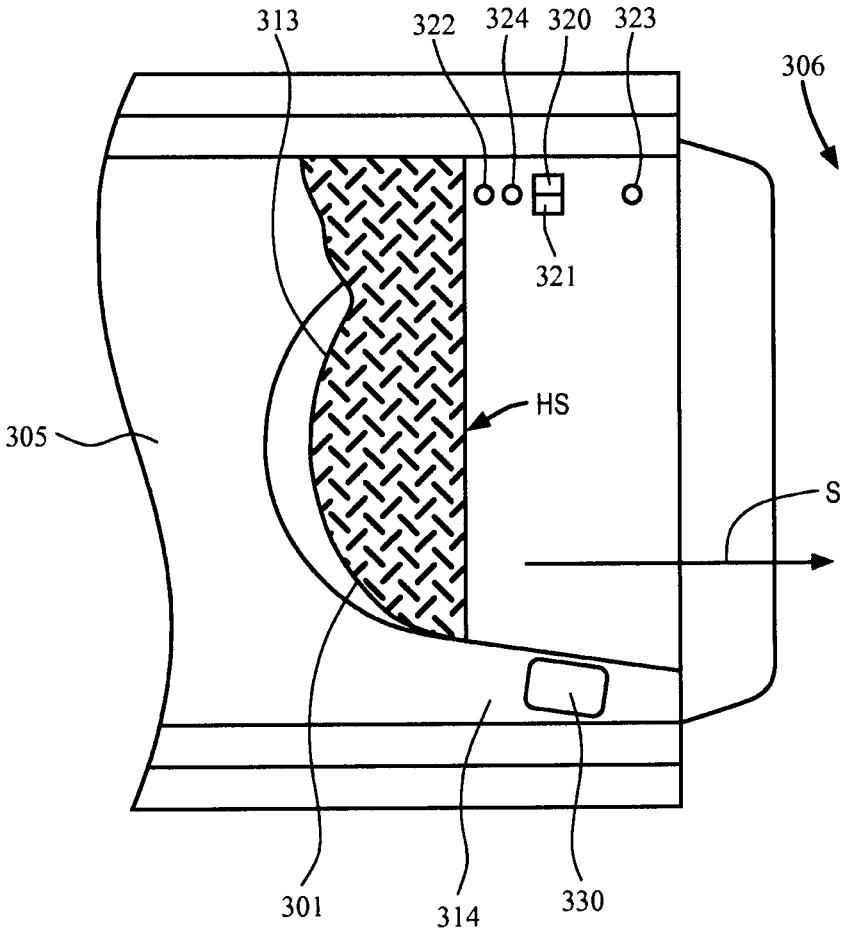
FIG. 8 is a plan view of a main portion of a card guide of the card shoe apparatus, with the card guide partially broken, according to an exemplary embodiment of the present invention.

Next, the code reading unit 308 that reads, from a card 301, the code 302 that indicates a figure (number, rank) of the card 301 when the card 301 is manually drawn out from the card housing unit 305 will be described in detail with reference to FIG. 8. The code reading unit 308 is provided in the card guide unit 307 that guides the cards 301 manually taken out one by one from an opening 313 onto the game table 306, with the opening 313 provided in a front portion of the card housing unit 305. The card guide unit 307 includes an inclined surface and a card guide 314 attached at an edge portion of each of both sides of the inclined surface, with the card guide 314 also serving as a sensor cover. The card guide 314 is configured to be attachable/detachable with screws or the like (not shown) so as to be replaceable. When a card guide 314 is removed, a sensor group 315 of the code reading portion 308 is exposed. The sensor group 315 is composed of four sensors, including two ultraviolet reactive sensors (UV sensors) 320 and 321, and object detection sensors 322 and 323.

The object detection sensors 322 and 323 are optical fiber sensors that each detect the presence of the card 301, and are capable of detecting movement of the card 301. The object detection sensor 322 is placed in the upstream side of the card guide unit 307 with respect to the travel direction of the card 301 (indicated by the arrow S in FIG. 8), and the object detection sensor 323 is placed in the downstream side of the card guide unit 307 with respect to the travel direction of the card 301. As shown in FIG. 8, the object detection sensors 322 and 323 are respectively provided in the upstream side and the downstream side of the UV sensors 320 and 321. The UV sensors 320 and 321 each include an LED (UV LED) that emits an ultraviolet ray and a detector. The marks M are printed on the card 301 in UV luminescent ink that emits color when UV ray is applied. The card 301 is irradiated with the UV ray (black light), and the detector detects the light reflected by the marks M of the code 302 of the card 301. The UV sensors 320 and 321 are connected to a control apparatus 312 of the code reading unit 308 via a cable. In the code reading unit 308, the arrangement patterns of the marks M are determined based on the output signals from the detectors of the UV sensors 320 and 321, such that the number (rank) corresponding to the code 302 is determined.

In the code reading unit 308, the start and end of the reading performed by the UV sensors 320 and 321 are controlled by the control apparatus 312 based on the detection signals from the object detection sensors 322 and 323. Also, the control apparatus 312 determines whether the card 301 has normally passed through the card guide unit 307 based on the detection signals from the object detection sensors 322 and 323. As shown in FIG. 7, the rectangular marks M are arranged within a framework of two rows with four columns on each of the upper and bottom edges of a card, and the arrangement of such marks indicates the rank (number) and the suit (Heart, Spade or the like) of the card. According to an exemplary embodiment, for each card, a mark M may either be present or absent at each of the predetermined locations within the framework of rows and columns depending on the particular mark and suit to be encoded. When the UV sensor(s) 320 and/or 321 detect(s) a mark M that is filled in, such UV sensor(s) output(s) an on signal, and when the UV sensor(s) 320 and/or 321 do not detect a mark M, an on signal is not generated. In this way, the code reading unit 308 identifies the code based on the relative difference or the like between the two marks M detected by the two UV sensors 320 and 321, thereby identifying the number (rank) and the type (suit) of the corresponding card 301.

Figure 10:
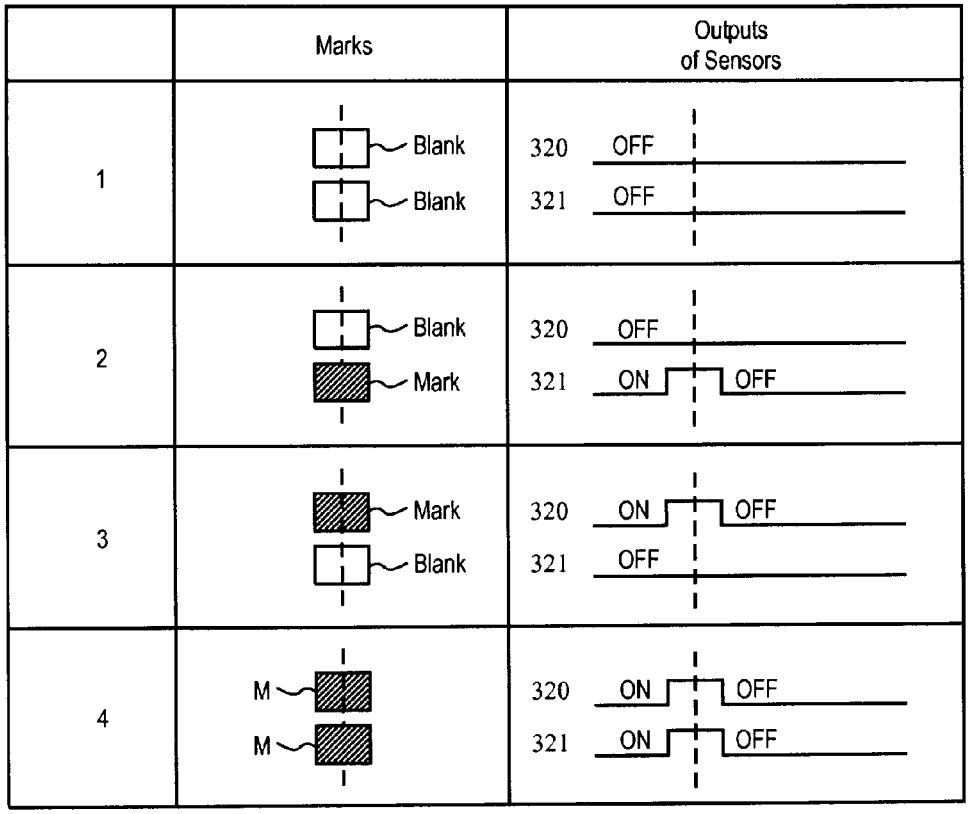
FIG. 10 is a diagram illustrating the relation between output waves from sensors and marks of a card according to an exemplary embodiment of the present invention.
Figure 11:
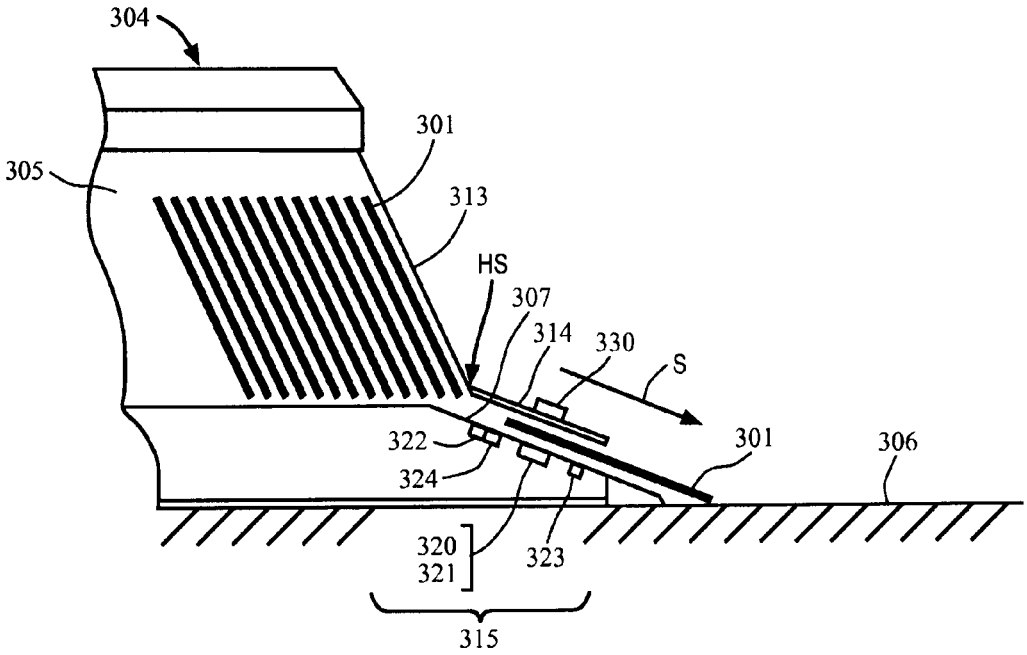
FIG. 11 is a block diagram illustrating a card shoe apparatus according to an exemplary embodiment of the present invention.

The relation between the code 302 and the output of the on signals from the two UV sensors 320 and 321 are shown in FIG. 10. It is possible to identify a predetermined arrangement pattern of the marks M based on the comparison results of the relative changes in the output of the on signals from the UV sensors 320 and 321. As a result, in two rows (the upper and lower rows), four types of arrangement patterns of the mark M are possible, and since patterns are printed in four columns, it is possible to form 256 types of codes (4×4×4×4). Fifty two (52) playing cards are each assigned to one of the 256 codes, and the relations of such assignment are stored in memory 12M as an association table. A configuration is thereby adopted in which the card reading unit 308 can, by identifying the code 302, identify the number (rank) and the type (suit) of the card 301 based on that predetermined association table (not shown). It should be appreciated that the assignment of a specific code of the 256 codes to each playing card does not need to be fixed, and in other exemplary embodiments of the invention each of the 52 cards can be freely associated with 52 codes out of the 256 codes to be stored in the association table, and thus a variety of associations are possible. Therefore, it is possible to change the associations between the 256 codes and 52 cards depending on the time or place. Preferably, the code is printed with a paint material that becomes visible when irradiated with UV ray, and placed in a position where it does not overlap the indications of the card types or indexes 402.

An association table may be prepared by freely associating 52 codes out of the 256 codes with 52 cards, and a plurality of different association tables (ex. 1 to 10 or more tables) may be prepared in advance. If the code 302 does not match the code defined in the applicable association table, an error is detected and it is determined that cheating may have occurred.

Next, the configuration of the control apparatus 312 will be described. The control apparatus 312, the code reading unit 308, the winning/losing determination unit 310 and the like are realized by a computer apparatus, and in particular a computer apparatus including at least a memory, at least a processor, and at least a non-transitory computer readable medium on which may be stored instructions that are read by the at least one processor to perform algorithms according to various exemplary embodiments of the present invention. The numbers of cards sequentially taken out onto the game table 306 are acquired using the UV sensors 320 and 321 in the code reading unit 308, and the numbers of cards thus acquired are sequentially stored in a memory. At this time, information on which card 301 is dealt to which player is also stored. The number of each card is stored in association with the player to whom that card was dealt. In baccarat, there is a player and a banker. The rank (number) of the card dealt is stored in the memory in association with the player to whom it was dealt, and the ranks (number) of the cards dealt are added for each player, and the winner is determined based on the programmed rules. A "tie" is also judged. The winning/losing determination unit 310 determines the winning/losing of the card game based on the numbers of the cards 301 sequentially read by the code reading unit 308 and whether the game of this round is over. When the game of this round is over, an operator or dealer is required to push a result key 360 on the side of a card shoe apparatus 304 to let the output means 311 output the result of the game.

Figure 9A:
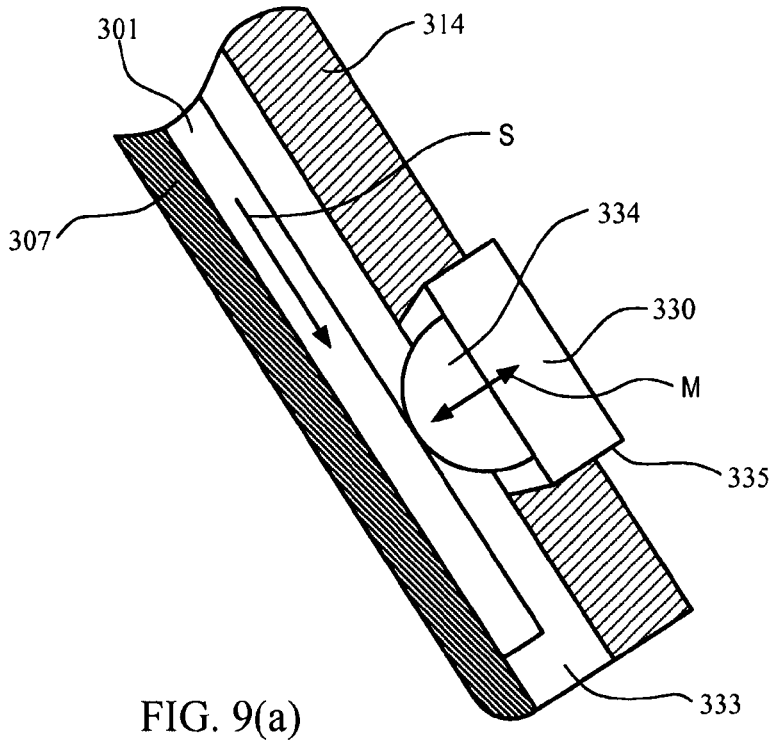
FIG. 9(*a*) is a cross-sectional view illustrating a main portion of a card movement restriction means according to an exemplary embodiment of the present invention that restricts the movement of cards from a card housing unit of the card shoe apparatus of FIG. 17 as viewed from the side.
Figure 9B:
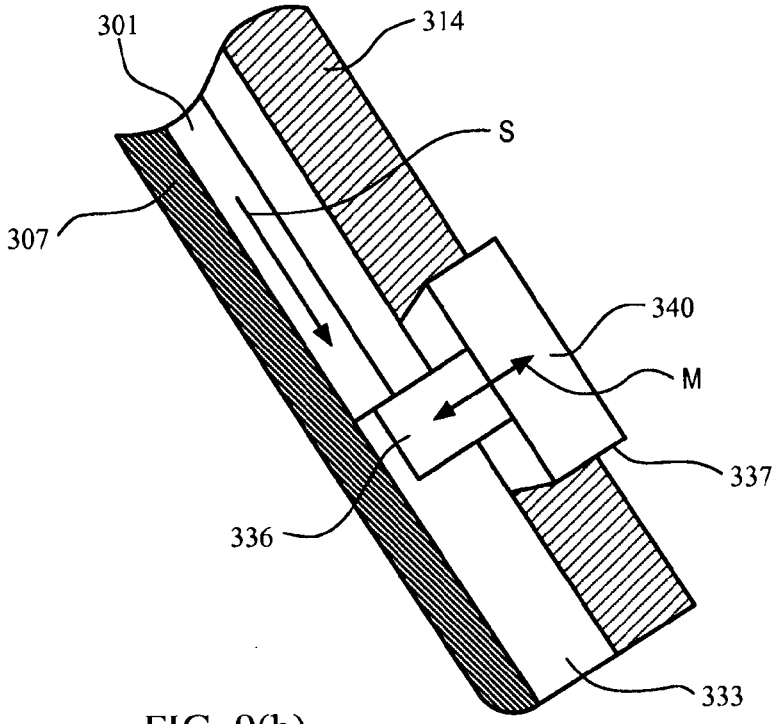

Next, the card movement restriction means 330 that restricts the movement of the card 301 to/from the card housing unit 305 will be described with reference to FIGS. 9(*a*), 9(*b*) and 11. In FIG. 9(*a*), the card movement restriction means 330 is provided in the card guide 314 of the card guide unit 307 that guides the cards 301 taken out one by one from the opening 313, which is provided in a front portion of the card housing unit 305. The card movement restriction means 330 has a structure by which when a card 301 passes through a slot 333 between the card guide unit 307 and the card guide 314, a lock member 334 presses the card 301 to prohibit the movement of the card 301 within the slot 333. The lock member 334 is capable of moving in the direction indicated by the arrow M by a driving unit 335 composed of an electromagnetic solenoid, a piezoelectric device or the like, such that it can take two positions, namely, a position where the card 301 is pressed (restricted position) and a position where the card 301 is allowed to pass through. The driving unit 335 is controlled by the control apparatus 312, and causes the lock member 334 to move to two positions, namely, a position where the card 301 is pressed and a position where the card 301 is allowed to pass through. The rules of the baccarat game are programmed and stored in advance in the control apparatus 312.

Next, an alternative embodiment of the card movement restriction means 330 will be described with reference to FIG. 9(*b*). According to this embodiment, a card movement restriction means 340 has a structure by which when a card 301 passes through the slot 333 between the card guide unit 307 and the card guide 314, a lock member 336 protrudes into the slot 333 to prohibit movement of the card 301. The lock member 336 is capable of moving in the direction indicated by the arrow M by a driving unit 337 composed of an electromagnetic solenoid, a piezoelectric device or the like, such that it can take two positions, namely, a position where movement of the card 301 is prohibited (restricted position) and a position where the card 301 is allowed to pass through. The driving unit 337 is controlled by the control apparatus 312, and causes the lock member 336 to move to two positions, namely, a position where movement of the card 301 is prohibited and a position where the card 301 is allowed to pass through.

The card movement restriction means 330 (340) is caused to function as a result of the driving unit 335 or 337 being controlled by the control apparatus 312 to prevent the fraudulent movement of the card 301. The card movement restriction means 330 (340) is provided with the object detection sensors 322 and 323 as sensors for detecting movement of the card 301, and has a function of detecting movement of the card 301 with these sensors 322 and 323 to restrict the erroneous or fraudulent movement of a card. In this regard, the card movement restriction means 330 (340) may be controlled to prevent the movement of the card 301 in at least the following situations:

1) when there is an attempt to draw a card at an inappropriate time. For example, the drawing of a card 301 from the card housing unit 305 may be prohibited when such drawing should not be allowed based on the information from the winning/losing determination unit 310. The winning/losing determination unit 310 determines the winning/losing of the card game based on the numbers of the cards 301 sequentially read by the code reading unit 308 and whether the game of the particular round is over. When the round is over, the dealer must push a result key 360 on the side of a card shoe apparatus 304 to instruct the output means 311 to output the result of the game. However, the dealer may attempt to withdraw a card after the round is over and before pushing the result key 360, in which case an overdraw error may be detected and the attempted withdrawal of the card may be prohibited by the card movement restriction means 330(340). In particular, when the object detection sensors 322 detects a card (FIG. 8), the card movement restriction means 330 (340) may be controlled to prohibit the drawing of a card 301 from the card housing unit 305 when such drawing should not be allowed. Since there is some distance between the position of the object detection sensors 322 and the position of the card movement restriction means 330 (340), there is enough time between when the object detection sensors 322 detects erroneous movement of a card and when the driving unit 335 or 337 begins operation to restrict the card from drawing further.

2) when the card stands still (stops) at predetermined period of time at the opening of the card housing unit. For example, when the object detection sensors 322 detects a card is being held in the card guide unit 307 for longer than a predetermined time, an error signal may be generated and, based on the error signal, the card movement restriction means 330(340) may prohibit further movement of the card. In this regard, a timer (not shown) may be activated when the object detection sensors 322 detect the card, and once the timer reaches a predetermined count, the card movement restriction means 330(340) may be controlled to prohibit further card movement.

3) when a card 301 is inserted from the exterior toward the card housing unit via the opening unit in a reverse direction, opposite to the direction of the arrow S, namely, from the exterior toward the card housing unit 305 via the opening 313. In this case, although the card 301 inserted for the purpose of cheating passes through the slot 333 between the card guide unit 307 and the card guide 314, the movement of the card 301 in a direction opposite to the normal direction (the direction opposite to the arrow S in FIG. 8) is detected based on the detection signals from the object detection sensors 322 and 323. The driving units 335 or 337 may then move their corresponding lock members 334 or 336 to their respective positions of pressing or blocking the card 301, respectively.

4) when a card is misread. For example, the card movement restriction means 330(340) may be controlled to prohibit movement of a card when the code reading unit 308 is unable to identify a code 302 on the card, such as when a code is not present on the card or when the code is present but does not correspond to any code within a code association table. A misreading error may also occur when it is detected that the card has not normally passed along the card guide unit 307 or has slipped back.

5) when an authenticity determination code detected by authenticity determination code sensor placed in the card guide unit 307 does not match the predetermined proper authenticity determination code. In this regard, a card 301 may be provided with an authenticity determination code 303 that is configured by encoding information that represents the group of the card. For example, card sets may be assigned a group code depending on the particular casino, casino group, casino location, geographical areas or countries in which the cards are intended for use. The authenticity determination code may be printed using, for example, UV ink, so as to be invisible to the naked eye, and is provided in the same position in at least the cards of the same set (i.e., all cards to be used at the same casino). The authenticity determination code 303 is made of a substance or material itself that emits, as a code, light rays of different wavelength spectra when irradiated with light rays. An authenticity determination code corresponding to a particular set of cards used in a card game may be stored in the memory unit and referred to by the control unit 312. Accordingly, the authenticity determination code 303 on a card can be read by the code reading unit 308 (sensor 324) and compared to the stored authenticity determination code. If there is a mismatch between the stored code and the code on the card, the card movement restriction means 330 (340) may be activated to prohibit further movement of the card.

5) when an authenticity determination code detected by authenticity determination code sensor placed in the card guide unit 307 does not match the predetermined proper authenticity determination code. In this regard, a card 301 may be provided with an authenticity determination code 303 that is configured by encoding information that represents the group of the card. The authenticity determination code may be printed using, for example, UV ink, so as to be invisible to the naked eye, and is provided in the same position in at least the cards of the same set. The authenticity determination code 303 is made of a substance or material itself that emits, as a code, light rays of different wavelength spectra when irradiated with light rays. An authenticity determination code corresponding to a particular set of cards used in a card game may be stored in the memory unit and referred to by the control unit 312. Accordingly, the authenticity determination code 303 on a card can be read by the code reading unit 308 (sensor 324) and compared to the stored authenticity determination code. If there is a mismatch between the stored code and the code on the card, the card movement restriction means 330(340) may be activated to prohibit further movement of the card.

The drawing of a card 301 from the card housing unit 305 may be prohibited when (1) the code 302 read by the code reading unit 308 does not match the code defined in the association table and (2) the authenticity determination code 303 detected by the authenticity determination code sensor 324 placed in the upstream side of the card guide unit 307 does not match the predetermined proper authenticity determination code. The presence of at least one of these conditions may be indicative of cheating, and an error signal may be generated so that the card movement restriction means 330 (340) is operated to prevent further movement of a card.

Upon operation of the card movement restriction means 330(340), an error signal output means 350 disposed on the card housing unit 305 may provide an external signal indicating that an error has occurred. The error signal output means 350 may include, for example, a lamp and/or an audible alarm.

According to an exemplary embodiment, the card movement restriction means 330(340) may be activated to prohibit delivery of further cards from a predetermined number of shuffled decks of cards when a number of times at least one kind of card appears is more than the total number of shuffled decks of playing cards. For example, the card movement restriction means 330(340) may be activated when a ninth ace of spades is detected in a set of cards drawn from eight shuffled decks of cards, indicating that there is at least one more card than would be appropriate based on the number of decks.

Figure 12A:
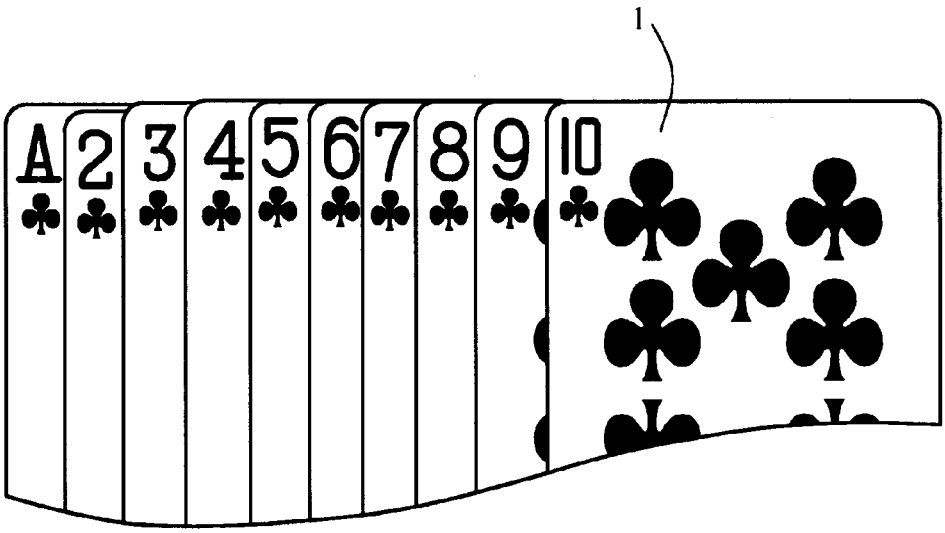
FIGS. 12(*a*) and 12(*b*) show cards that have been improperly shuffled according to exemplary embodiments of the present invention.
Figure 12B:
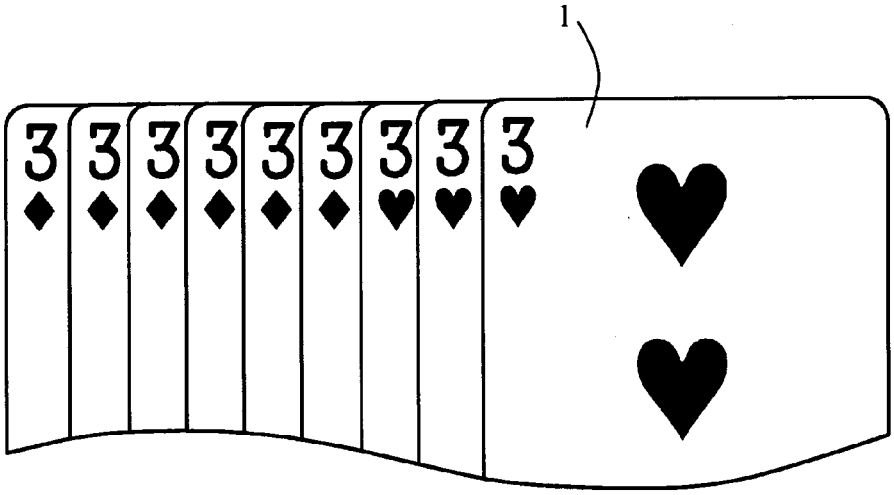

According to an exemplary embodiment of the present invention, the card shoe apparatus 304 may detect an irregularity in the manner in which the cards are shuffled and in some cases generate an alert and/or prohibit removal of cards from the card housing unit 305 based on the detected irregularity. In this regard, the information collected by the card reading unit 308 as the cards are drawn from the card housing unit 305 may be used to determine whether the cards have been shuffled improperly. An irregularity in the arrangement order of the cards will be described with reference to FIG. 12(*a*) and FIG. 12(*b*). FIG. 12(*a*) shows an example where the cards 301 drawn from the card housing unit 305 have the same suit (Clubs) with sequential figures (number, rank) beginning from Ace. FIG. 12(*b*) shows an example where the cards 301 drawn from the card housing unit 305 consist of 9 cards with the same rank (3). Generally, the cards 301 are shuffled by a random number generator or the like so as to be arranged in a random order. The arrangement of the cards 301 shown in FIGS. 12(*a*) and 12(*b*) is substantially non-random, thus indicating an irregular shuffling of the playing cards 301. Other examples of card arrangements which may indicate a shuffling irregularity include:

(a) a case in which a predetermined number of cards within a set of cards exhibit a pattern in which the rank of a card is larger (or smaller) by one as compared to the rank of the preceding card (for example, 1, 2, 3, 4, - - - , K) (as shown in FIG. 12(*a*));

(b) a case where a predetermined number of cards in sequence have the same rank (for example, A, A, A, A, - - -) (as shown in FIG. 12(*b*));

(c) a case where the same sequence is repeated throughout a predetermined number of cards (for example, A, Q, 10, A, Q, 10, - - -);

(d) a case where a predetermined number of cards in sequence have the same suit (for example, 13 consecutive cards with Hearts);

(e) a case in which a predetermined number of cards in each of two or more sets of cards have the same sequence of suit and rank (A,5,Q,J,2,8,9,K, - - -). In particular, for each card game, a different set of cards may be housed in the card shoe apparatus 304. A shuffling irregularity may be detected if a predetermined number of cards in a later-used set match the same predetermined number of cards in an earlier-used set in terms of suit and/or rank sequence; and (f) a case where the order of a predetermined number of cards matches an order registered in advance (for example, where the order of the cards matches the order of cards used in a separate card manufacturing process).

Irregular shuffling patterns (such as examples (a)-(d)) as well as the sequence of suit and rank (e.g., A,5,Q,J,2,8,9, K, - - -) of card sets previously housed in the card shoe apparatus 304 may be stored in the memory 312M, and the control unit 312 may use this stored information to determine whether irregular shuffling has occurred. For example, irregular shuffling may be determined if the order of a predetermined number of cards 301 within a set matches at least a portion of the stored patterns. In another example, irregular shuffling may be determined if a number of card sets each used in one of a predetermined number of games include a predetermined number of cards that match the stored patterns.

As another example, a shuffling irregularity may be determined when each deck of cards within a set of cards is detected to be shuffled in the same or substantially similar way. For example, a shuffling irregularity may be detected when, for a plurality of cards, the suit and rank of each card drawn are the same as those of the card preceding it by 52 cards. In such a case, shuffling of a plurality of decks has failed for some reason, and instead each of the 52 cards is arranged in the same order.

In general, a shuffling irregularity may be detected when a stored pattern continues throughout a predetermined number of cards. In this regard, a preliminary alarm of irregularity may be generated at some point prior to the stored pattern being detected in all of the predetermined number of cards. For example, a preliminary alarm may be generated upon the drawing of a card that is several cards before the end of a predetermined number of cards. The preliminary alarm may be in a form different from the final alarm, for example, by characters, in a certain color, or with a different lamp. In an exemplary embodiment, if a state does not continue to be irregular throughout a predetermined number of cards and returns to a random state, then the preliminary alarm may be cancelled.

If a shuffling irregularity is detected, a final alarm may be generated and the control unit 312 may operate the card movement restriction means 330(340) to restrict movement of the card 301 relative to the opening 313 in the card housing unit 305.

The preferred embodiment of the invention has been described hitherto. However, it is natural that the invention is not limited to the above-described embodiment, but persons skilled in the art can alter the above-described embodiment within the scope of the invention.

What is claimed is:

1. A method of checking one or more shuffled decks of playing cards, wherein each of the one or more shuffled decks of playing cards are shuffled at random, each of the one or more shuffled decks of playing cards is contained within a corresponding package having a sealing label, and a shuffled card ID associated with the shuffled deck of playing cards is attached to the package, the method comprising the steps of:

automatically detecting, using one or more processors, at least a rank of each card delivered by a card feeder from the one or more shuffled decks of playing cards;

inspecting, using the one or more processors, the one or more shuffled decks of playing cards after shuffling;

upon a condition that a shuffled deck of playing cards is determined to be defective based on the inspecting, treating or handling the set of playing cards which is determined to be defective as a defective item.

2. The method according to claim 1, wherein the step of inspecting comprises determining whether or not each card complies with predetermined standards.

3. The method according to claim 1, wherein the shuffled card ID is associated with production information of the one or more shuffled decks of playing cards, and the production information is related to identification of a manufacturing line used to shuffle the one or more decks of shuffled playing cards.

4. The method according to claim 1, wherein the shuffled card ID associated with the shuffled deck of playing cards is attached to the sealing label.

5. The method according to claim 1, wherein the shuffled card ID is a bar code, RFID tag, RF tag or a two-dimensional matrix code.

6. The method according to claim 1, wherein the shuffled card ID is further associated with product type of the shuffled deck of playing cards, shipment information or customer information.

7. The method according to claim 1, wherein each shuffled card ID is registered in a database by associating the shuffled card ID with information related to a shuffling machine or a shuffling machine group used to shuffle the shuffled deck of playing cards to which the shuffled card ID is attached.

8. The method according to claim 1, wherein a predetermined number of shuffled decks of playing cards are individually packaged.

9. The method of claim 1, further comprising the step of, controlling, based on the automatic detection, using the one or more processors, operation of a lock member to restrict movement of cards of the set of cards from the card housing.

10. A method of checking one or more shuffled decks of playing cards, wherein each of the one or more shuffled decks of playing cards are shuffled at random, each of the one or more shuffled decks of playing cards is contained within a corresponding package having a sealing label, and a shuffled card ID associated with the shuffled deck of playing cards is attached to the package, the method comprising:

automatically detecting, using one or more processors, an improper set of cards from the one or more shuffled decks of playing cards comprising a predetermined number of cards delivered from a card housing, wherein a set of cards is detected to be improper upon detection of one or more of the following conditions:

1) a number of times at least one kind of card appears in the predetermined number of cards is more than a total number of the shuffled decks of playing cards; and 2) an improper shuffling of the predetermined number of cards; and based on the automatic detection, generating, using one or more processors, an error signal indicating that an error has occurred.

11. The method of claim 10, wherein detection of improper shuffling of the predetermined number of cards comprises the step of determining, using one or more processors, relative arrangement of the predetermined number of cards.

12. The method of claim 11, wherein the step of determining relative arrangement comprises determining at least one of rank or suit of each of the predetermined number of cards drawn in sequence from the card housing unit.

13. The method of claim 12, wherein detection of improper shuffling comprises determining whether the ranks of cards increase or decrease in order.

14. The method of claim 12, wherein detection of improper shuffling comprises determining whether each of the predetermined number of cards have the same rank.

15. The method of claim 12, wherein detection of improper shuffling comprises determining whether each of the predetermined number of cards are of the same suit.

16. The method of claim 12, wherein detection of improper shuffling comprises determining whether a repeating sequence of rank or suit is present within the predetermined number of cards.

17. The method of claim 12, wherein detection of improper shuffling comprises determining whether the determined relative arrangement matches a pre-stored relative arrangement.

18. The method of claim 12, wherein detection of improper shuffling comprises determining whether each of the predetermined number of cards have the same rank and are of the same suit as compared to a corresponding card in a preceding deck of cards in the set.

19. The method of claim 12, wherein detection of improper shuffling comprises determining whether each of the predetermined number of cards have the same rank and are of the same suit as compared to a corresponding card in a preceding set of cards checked in a previous detection.

20. The method of claim 12, wherein detection of improper shuffling comprises reading a code on each card that indicates at least one of a number or a suit of the card.

21. The method of claim 20, wherein detection of improper shuffling comprises comparing the code with a predetermined code stored in memory.

22. The method of claim 12, wherein detection of improper shuffling comprises reading an authenticity determination code on each card.

23. The method of claim 22, wherein detection of improper shuffling comprises comparing the authenticity determination code on each card with a predetermined authenticity determination code stored in memory.

24. The method of claim 10, further comprising the step of, controlling, based on the automatic detection, using the one or more processors, operation of a lock member to restrict movement of cards of the set of cards from the card housing.

* * * * *